US005950323A

United States Patent [19]

Wroth et al.

[11] Patent Number: 5,950,323

[45] Date of Patent: Sep. 14, 1999

[54] DESICCANT ACCESSORY FOR SHOES AND THE LIKE

[76] Inventors: Elizabeth Wroth, 18000 Elgin Rd.; Kathy Sheraw, 2 Haller Ct., both of Poolesville, Md. 20837

[21] Appl. No.: 09/137,420

[22] Filed: Aug. 20, 1998

Related U.S. Application Data

[60] Provisional application No. 60/056,526, Aug. 21, 1997.

[51] Int. Cl.[6] ..... F26B 25/00

[52] U.S. Cl. ..... 34/104; 34/80; 34/81; 34/202; 36/3 B; 12/128 R; 12/128 B

[58] Field of Search ..... 34/80, 95, 95.1, 34/104, 105, 107, 202, 472; 12/128 R, 128 B; 36/3 B

[56] References Cited

U.S. PATENT DOCUMENTS

| | | | |
|---|---|---|---|
| 896,536 | 8/1908 | Hayden | 12/114.2 |
| 2,210,862 | 8/1940 | Tronstad | 96/154 |
| 2,435,131 | 1/1948 | Desbiens | 36/87 |
| 2,671,277 | 3/1954 | Montgomery | 34/95.1 |
| 2,713,214 | 4/1955 | Gulaskie | 36/44 |
| 3,131,036 | 4/1964 | Hirschberg | 34/95.1 |
| 4,497,080 | 2/1985 | Inspector | 12/128 R |
| 5,078,909 | 1/1992 | Shigeta et al. | 252/194 |
| 5,291,669 | 3/1994 | Khoury et al. | 34/95.1 |
| 5,542,191 | 8/1996 | Shouse et al. | 34/104 |

*Primary Examiner*—Henry Bennett
*Assistant Examiner*—Pamela A. Wilson
*Attorney, Agent, or Firm*—Laubscher & Laubscher

[57] ABSTRACT

A desiccant accessory for shoes and the like is provided for the removal of moisture therefrom. The accessory includes an external pouch having an internal chamber with an opening at one end, a transparent packet made of permeable material detachably connected with the pouch adjacent the open end, a reusable desiccant arranged in the packet for adsorbing moisture from surrounding air, and an indicator combined with the desiccant for alerting a user when the desiccant has adsorbed a maximum amount of moisture.

11 Claims, 2 Drawing Sheets

DESICCANT ACCESSORY FOR SHOES AND THE LIKE

This application is based on provisional application No. 60/056,526 filed Aug. 21, 1997.

BACKGROUND OF THE INVENTION

The present invention relates to a desiccant accessory for removing moisture from shoes and the like having reusable desiccant stored within an exterior pouch which indicates to a user when the desiccant has adsorbed a maximum amount of moisture.

Removal of excessive moisture from footwear, handwear, or the like is useful to prolong the life of and reduce odors and unsightly stains which detrimentally effect such items. After prolonged periods of wear, substantial amounts of moisture can be transferred to footwear where it accumulates. Upon removal from the foot, the moisture will slowly evaporate from the footwear, giving ample time for moisture to damage the materials of the shoe, and for odors to develop. It is therefore useful to provide an accessory for footwear or the like which is capable of quickly and efficiently removing moisture, thus prolonging each item's useful life.

BRIEF DESCRIPTION OF THE RELATED ART

Currently, there are several techniques and devices for prolonging the life of a shoe. Most common are shoe trees which are generally inserted into a shoe and expanded to cause the shoe to be maintained in its original form. Some of the shoe trees are constructed of aromatic woods such as cedar which help to remove moisture and disguise odor.

While a shoe tree performs well in maintaining the shape of the shoe, it is of limited value for removing moisture. Many times, the exterior portion of the shoe tree can become saturated with moisture and actually trap moisture between the tree and the inner surface of the shoe. The present invention was developed in order to overcome these and other drawbacks by providing a desiccant accessory for shoes or the like in which the desiccant completely removes moisture from every portion of the shoe and indicates to a user when it has become saturated and needs replacing.

SUMMARY OF THE INVENTION

Accordingly, a primary object of the invention is to provide a desiccant accessory having a pouch defining a chamber which is open at one end, a packet made of transparent permeable material connected with the pouch adjacent to the open end, a reusable desiccant arranged in the packet for adsorbing moisture from surrounding air, and an indicator combined with the desiccant for alerting a user when the desiccant has adsorbed a maximum amount of moisture.

It is another object of the invention to provide a desiccant accessory wherein the packet can be detached from the pouch in order to be dehydrated for later reuse.

Another object of the invention is to provide a desiccant accessory having two identical pouches, each containing a desiccant package, wherein a segment of cord interconnects the packets, and thereby makes it convenient to use the accessory with items that exist in pairs, such as shoes and gloves.

BRIEF DESCRIPTION OF THE DRAWINGS

Other objects and advantages of the invention will become apparent from a study of the following specification when viewed in light of the accompanied drawings, in which.

DETAILED DESCRIPTION

Figure 1:
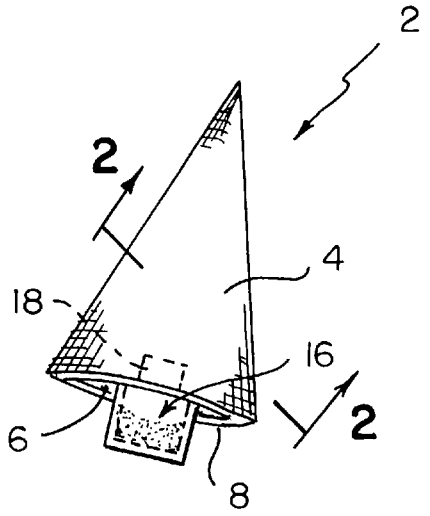
FIG. 1 is a top plan view of a desiccant accessory according to the invention.
Figure 2:
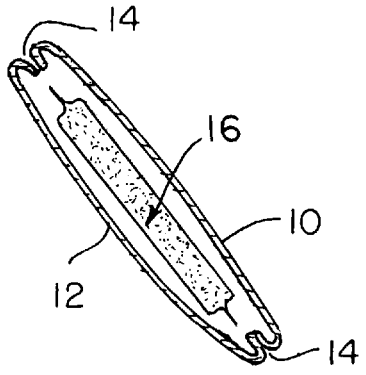
FIG. 2 is a cross sectional view of the desiccant accessory taken along line 2—2 of FIG. 1.

Referring to FIG. 1, there is shown a desiccant accessory 2 having a pouch 4 which defines an inner chamber 6 having an opening 8 at one end. As shown in FIG. 2, the pouch is formed by attaching a first piece of material 10 atop a second identically shaped piece 12 in a parallel manner along an outer portion 14 of their periphery. The attachment can be accomplished by various means, including sewing and gluing. The pouch 4 is preferably constructed from cotton fabric. However, any suitable material can be used.

Referring again to FIG. 1, a packet 16 is detachably connected within the pouch inner chamber 6 and adjacent the opening 8. The detachable connection 18 can be in the form of hook and loop type fasteners, a snap, a button, or any other means known in the art. The packet 16 is constructed of a material that is both partially transparent and permeable to moisture, such as polyester.

Figure 3:
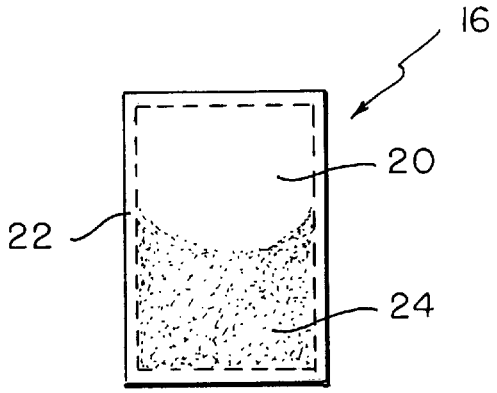
FIG. 3 is a top plan view of a packet containing a desiccant material according to the invention.
Figure 4A:
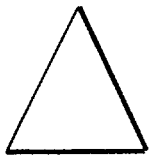
FIGS. 4*a*–4*d* represent alternative shapes, respectively, of the pouch according to the invention.
Figure 4B:
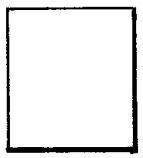
Figure 4C:
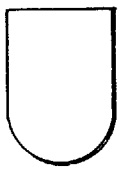
Figure 4D:
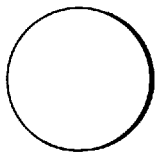

As shown in FIG. 3, in a preferred embodiment, the packet 16 has a relatively simple construction comprising two identical pieces of material 20 which are positioned atop and parallel to one another and sealed together along their outer periphery 22.

A reusable desiccant 24 is arranged within the packet 16. The weave of the material of the packet 16 and its seal are tight enough to prevent the desiccant 24 contained therein from escaping. The desiccant is a material that is capable of adsorbing large amounts of moisture from surrounding air relative to its own mass. The preferred material to be used as a desiccant is silica dioxide ($SiO_2$). However, it should be noted that other well known desiccants may be readily substituted.

The desiccant 24 includes an indicator combined therewith for indicating the amount of moisture adsorbed by the desiccant. Preferably, the indicator is cobalt chloride and it is combined with the desiccant by treating it with a concentration of cobalt chloride.

Cobalt chloride has the property that it is a deep blue color when it is dry, and changes to purple, then to pink as it becomes saturated. Typically, the color changes as the desiccant to which the cobalt chloride is attached adsorbs an eight percent (8%) moisture level (by weight), and thereby indicates that it is time to replace the desiccant. In use, a quick visual inspection of the packet 16 containing the desiccant 24 indicates to the user whether the desiccant has become saturated. After extended use, usually several days to several weeks depending on the moisture content of the shoe and the surrounding ambient humidity, the desiccant 24 will change color from a dry blue to a saturated pink. At that time, a user will detach the packet tab from the pouch 4 and dehydrate it for later reuse. Dehydration may be accomplished by heating the desiccant in a microwave or conventional oven until the moisture is removed, as will be indicated by a return to its dry blue state.

Referring now to FIGS. 4*a* through 4*d*, there are shown other possible shapes of the first 10 and second 12 pieces of material which when attached to each other form the pouch 4. When various shapes are attached to each other, it is important to note that a portion of their periphery must remain unattached to form the opening 8.

Figure 5:
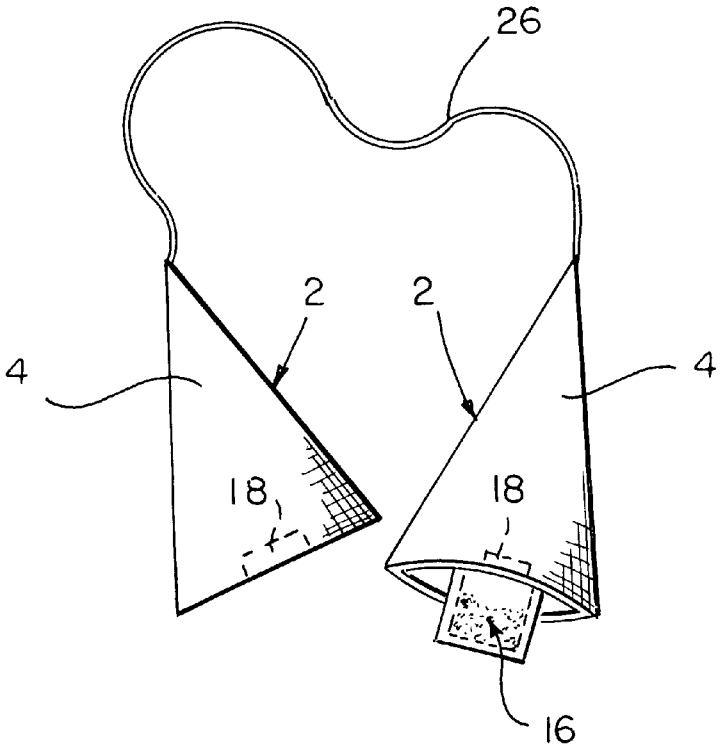
FIG. 5 is a top plan view of a preferred embodiment of a paired desiccant accessory according to the invention.

As shown in FIG. 5, an alternative embodiment of the invention exists where a pair of desiccant accessories 2 are interconnected by a segment of cord 26 attached to the outer pouches 4 of the respective accessory 2. In this paired configuration, the desiccant accessory is useful when drying out items which normally exist in pairs such as shoes and gloves.

Figure 6:
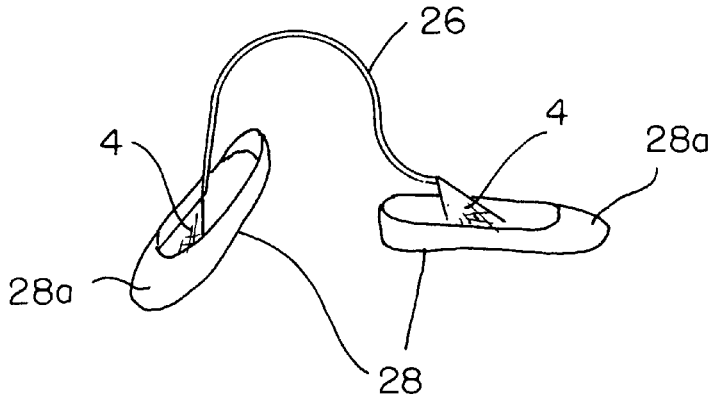
FIG. 6 is a perspective view showing the arrangement of the desiccant accessory within a pair of shoes according to the invention.

FIG. 6 shows how to use the desiccant accessory 2. Here, a pair of shoes 28 receives one of the pouches 4 in the forward toe portion 28*a* of the shoe. The pouches 4 will remain in their respective shoe as the desiccant removes unwanted moisture therefrom. Additionally, to increase the moisture adsorption ability of the desiccant, the shoes can be further placed in an air tight bag or container to reduce the amount of ambient humidity that desiccant will adsorb moisture from the surrounding environment.

While in accordance with the provisions of the Patent Statutes, the preferred forms and embodiments of the invention have been illustrated and described, it will be apparent to those of ordinary skill in the art that various changes and modifications may be made without deviating from the inventive concepts set forth above.

What is claimed is:

1. A desiccant accessory for shoes, comprising:

(a) a pouch defining a chamber open at one end;

(b) a packet connected with said pouch adjacent to said one end, said packet being formed of a partially transparent permeable material;

(c) a reusable desiccant arranged in said pouch for adsorbing moisture from surrounding air; and (d) indicator means combined with said desiccant for indicating the amount of moisture adsorbed by said desiccant, whereby when said pouch is arranged in the forward portion of a shoe said indicator means indicating to a user when said desiccant has adsorbed a maximum amount of moisture, and therefore, requires dehydration.

2. A device as defined in claim 1, wherein said pouch comprises two pieces of fabric, said fabric pieces being arranged atop one another in a parallel manner and connected along an outer portion of their periphery.

3. A device as defined in claim 1, wherein said packet is detachably connected with said pouch, whereby when said packet becomes saturated it can be easily detached from said pouch for dehydration.

4. A device as defined in claim 3, wherein said packet is detachably secured to said pouch by a hook and loop type fastener.

5. A device as defined in claim 1, wherein two of said desiccant accessories are interconnected with each other by a cord segment.

6. A device as defined in claim 1, wherein said reusable desiccant is silica dioxide.

7. A device as defined in claim 1, wherein said indicator means comprises cobalt chloride.

8. A device as defined in claim 2, wherein said fabric pieces are triangular in shape.

9. A device as defined in claim 2, wherein said fabric pieces are rectangular in shape.

10. A device as defined in claim 2, wherein said fabric pieces are circular in shape.

11. A device as defined in claim 2, wherein said fabric pieces are of a rectangular shape on a first end and of a circular shape on a second end.

* * * * *